US005219493A

United States Patent [19]

Seshadri

[11] Patent Number: 5,219,493

[45] Date of Patent: Jun. 15, 1993

[54] COMPOSITION AND METHOD FOR ENHANCING THE SURFACE CONDUCTIVITY OF THERMOPLASTIC SURFACES

[75] Inventor: Sri R. Seshadri, Newtown, Pa.

[73] Assignee: Henkel Corporation, Ambler, Pa.

[21] Appl. No.: 713,904

[22] Filed: Jun. 12, 1991

[51] Int. Cl.[5] ..... H01B 1/00

[52] U.S. Cl. ..... 252/500; 252/512; 252/518; 427/400; 524/186; 524/217; 524/284

[58] Field of Search ..... 252/500; 427/96, 101, 427/122, 400; 524/186, 217, 284; 106/14.13, 14.5

[56] References Cited

U.S. PATENT DOCUMENTS

| | | | |
|---|---|---|---|
| 3,689,810 | 9/1972 | Walles | 252/500 |
| 3,888,678 | 6/1975 | Bailey, Jr. et al. | 252/500 |
| 4,147,742 | 4/1979 | Castro et al. | 260/897 |
| 4,268,583 | 5/1981 | Hendy | 428/516 |
| 4,774,029 | 9/1988 | Poulin | 260/501 |
| 4,904,825 | 2/1990 | Govindan | 544/170 |
| 4,980,086 | 12/1990 | Hiraiwa et al. | 252/511 |

FOREIGN PATENT DOCUMENTS

| | | |
|---|---|---|
| 2146777 | 3/1973 | France . |
| 1124210 | 5/1989 | Japan . |
| 1253154 | 11/1971 | United Kingdom . |

OTHER PUBLICATIONS

Elect. Cond. & Therm. Power, Japanese Journal of Applied Physics, pp. 647-649, Apr. 1, 1991.

*Primary Examiner*—Paul Lieberman
*Assistant Examiner*—M. Kopec
*Attorney, Agent, or Firm*—Ernest G. Szoke; Wayne C. Jaeschke; Norvell E. Wisdom, Jr.

[57] ABSTRACT

The invention relates to a surface treatment composition and a method of using the composition to provide the treated surface with a suitable surface conductivity for electrostatic painting of the surface. The surface treatment composition preferably comprises a mixture of: (a) a substituted or unsubstituted aromatic polycarboxylic acid, anhydride or salt thereof, and (b) a quaternary ammonium salt or (b') an ethoxylated tertiary fatty amine, in a compatible vehicle, said composition having a pH of below about 4.5, said polycarboxylic acid and said quaternary ammonium salt or ethoxylated fatty amine each being present in said composition in an amount effective to impart to said thermoplastic surface a resistivity value of between about $10^8$ ohms/cm$^2$ and about $10^{12}$ ohms/cm$^2$, or a 90% electrostatic charge decay time of less than five seconds, or both.

9 Claims, No Drawings

COMPOSITION AND METHOD FOR ENHANCING THE SURFACE CONDUCTIVITY OF THERMOPLASTIC SURFACES

FIELD OF THE INVENTION

The invention relates to a composition and method for treating thermoplastic surfaces to enhance the electrical conductivity of the surfaces; the method is particularly useful as a pretreatment prior to the application of an electrostatically applied protective coating on the treated surfaces.

BACKGROUND OF THE INVENTION

Thermoplastic components used in automobile production are commonly provided with electrostatically applied surface coatings. For example, thermoplastic parts, such as bumper parts, may be electrostatically painted with an acrylic base and clear coat to give the surface a glossy appearance. In order to promote uniformity of coating for such electrostatically applied surface coatings, it is desirable to enhance the normally low inherent surface electrical conductivity of thermoplastic surfaces before electrostatically coating the surfaces.

It is known to use a solvent-based primer or pretreatment composition containing carbon black in such electrostatic coating operations. This prior art primer composition has not been adapted for use on a production line. Rather, the thermoplastic parts are primed "off-line". The inefficiency inherent in such a coating operation, in an otherwise integrated production system, is apparent.

A solvent-based priming composition, believed to be an quaternary ammonium salt solution in isopropanol, has been used as a surface treatment composition in an "on-line" coating operation. However, this method is attended by some difficulties: isopropanol is quite volatile, making use of solutions in it technically difficult, and thermoplastic surfaces treated with this composition cannot be water-rinsed for environmental reasons.

SUMMARY OF THE INVENTION

It is an object of this invention to provide a surface treatment composition for thermoplastics capable of imparting a desirable level of surface conductivity for electrostatic coating.

It is another object of this invention to provide a method for applying the surface treatment composition to thermoplastics in an on-line production system.

It is a further object of the invention to provide a surface treatment composition for thermoplastics which has a relatively low volatile organic content, and which otherwise minimizes the use of environmentally damaging substances.

It is an additional object of the invention to provide a surface treatment composition for thermoplastics which is sufficiently durable to remain substantially effective even after a surface that has been treated with the composition is water rinsed.

It is yet a further object of the invention to provide a surface treating composition for thermoplastics that promotes good adhesion to electrostatically applied finish coatings that are subsequently applied.

It has been surprisingly found that the above objects are accomplished by the surface treatment composition of the invention which comprises, or preferably consists essentially of, a mixture, in a solvent vehicle (preferably an aqueous vehicle), of: (a) a substituted or unsubstituted aromatic polycarboxylic acid, anhydride, or salt thereof, and (b) a quaternary ammonium salt or (b') an ethoxylated fatty amine, the composition preferably having a pH of below about 4.5, with the polycarboxylic acid and quaternary ammonium salt or ethoxylated fatty amine each being present in the composition in a sufficient amount that the thermoplastic surface after treatment with the composition has a resistivity value of between about $10^8$ and $10^{12}$ ohms/cm$^2$, or a 90% electrostatic charge decay time of less than five seconds. A surface film or layer of the residual composition produced by treating the surface with a treatment composition according to the invention on the order of 1 micron in thickness is generally sufficient to achieve this level of conductivity.

The above specification of the ingredients in the treatment composition refers to ingredients in the form added to water when making the composition, and does not preclude the possibility of chemical reaction among the ingredients during or before use of the composition.

The present invention also provides an improved method for electrostatically coating thermoplastics using the above described composition. The method of the invention is readily adaptable to on-line operation. Moreover, the resultant coating formed on the treated surface is substantially resistant to removal by rinsing or washing the treated surface with water.

Also in accordance with this invention, there is provided a thermoplastic article of manufacture, such as bumper parts, treated with the surface treatment composition of the invention, which exhibits good adhesion to a subsequently applied electrostatic coating.

DETAILED DESCRIPTION OF THE INVENTION

As noted above, the principal components of a surface treatment composition of the invention are a substituted or unsubstituted aromatic polycarboxylic acid, anhydride, or salt thereof and a quaternary ammonium salt and/or an ethoxylated tertiary fatty amine.

Representative examples of aromatic polycarboxylic acid components suitable for use in the practice of the invention include 4-amino-1,8-naphthalic anhydride; 1,2,4,5 benzene tetracarboxylic acid or its anhydride; aurintricarboxylic acid; 1,2,3-benzene tricarboxylic acid; 1,2,4-benzene tricarboxylic acid; 3,3',4,4'-benzophenone tetracarboxylic acid; 2-bromoterephthalic acid; 4-chloro-1,8-naphthalic anhydride; 4-chlorophthalic acid; homophthalic acid; mellitic acid; 2,3-naphthalene dicarboxylic acid; 2,6-naphthalene dicarboxylic acid; 1,4,5,8-naphthalene tetracarboxylic acid; 1,8-naphthalic anhydride; 3-nitrophthalic acid; 1-nitrophthalic anhydride; 3,4,9,10 perylene tetracarboxylic acid dianhydride; 4-sulfo-1,8-naphthalic anhydride; tetrachlorophthalic anhydride; and trimellitic anhydride. The various dibasic and monobasic salts of the foregoing acids with alkali metal salts and alkaline earth metal salts may also be used, if desired. Preferred are aromatic dicarboxylic acids, anhydrides, or salts thereof selected from the group consisting of phthalic acid, phthalic anhydride, isophthalic acid, terephthalic acid, homophthalic acid or the mono-alkali metal salt of any of such acids. Especially preferred are phthalic acid, phthalic anhydride or the mono-alkali metal salts of phthalic acid.

The quaternary ammonium salts or ethoxylated fatty amines which may be used in the surface treatment composition of the invention are those which are soluble or dispersable in an aqueous solution of the foregoing aromatic carboxylic acid at a relatively highly acidic pH.

Preferred quaternary ammonium salts have the formula

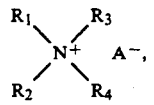

wherein $R_1$ is selected from branched or unbranched alkyl or alkenyl substituents having 6 to 22 carbon atoms, or a substituent of the formula Ra—X—Rb, wherein Ra is a branched or unbranched monovalent group having 6 to 19 carbon atoms, Rb is a monovalent group having from 1 to 3 carbon atoms, each of Ra and Rb independently being hydrocarbon groups or groups that are hydrocarbons except for being substituted with a functionality selected from the group consisting of —COOH and —OH; and X represents a linking moiety selected from the group consisting of —O—, —CONH—, or —COO—; $R_2$ is selected from the group consisting of branched or unbranched alkyl or hydroxyalkyl groups having 1 to 4 carbon atoms; each of $R_3$ and $R_4$ is independently selected from branched and unbranched alkyl and alkenyl groups, groups that are hydrocarbons except for being substituted with a functionality selected from the group consisting of —COOH or —OH, and groups of the formula Ra—X—Rb as given above, each of said $R_3$ and $R_4$ containing from 1–22 carbon atoms; and $A^-$ represents a halide, nitrate or a lower alkyl sulfate anion. Mixtures of salts in which each component in the mixture separately conforms to the formula given above are equally as preferred as a single type of quaternary ammonium salts.

Examples of suitable quaternary ammonium salts include stearyldimethylethyl-ammonium ethosulfate, stearamidopropyldimethyl-$\beta$-hydroxyethyl ammonium nitrate, N, N-bis(2-hydroxyethyl)-N-(3'-dodecyloxy-2'-hydroxypropyl) methylammonium methosulfate, or tricaprylmethylammonium chloride, sold by Henkel Corporation under the trademark "ALIQUAT ®366". Mixture of the foregoing quaternary ammonium salts may be used, if desired. Especially preferred is stearyldimethylethyl-ammonium ethylsulfate which is sold by PPG/Mazer Chemicals under the trademark LAROSTAT ®451, and is hereinafter referred to as "L451".

Ethoxylated tertiary fatty amines may also be advantageously incorporated in the surface treatment composition of the invention, in addition to or in lieu of quaternary ammonium salts as described above. Suitable compounds of this type may be obtained by ethoxylating a fatty amine such as coco, soya, oleyl, tallow or stearyl amine, resulting in the formation of tertiary amines substituted with two or more polyoxyethylene groups attached to a nitrogen atom. The nature of the alkyl chain and the length of the polyoxyethylene groups will determine the physical characteristics of the resultant amine, and properties suitable for the composition of the present invention may be selected by varying those parameters. For purposes of the present invention, the tertiary fatty amine is preferably substituted with two polyoxyethylene groups. Preferred tertiary fatty amines may comprise a fatty side-chain having a lower limit of at least $C_{12}$ with the upper limit being determined by the solubility of the fatty amine in the acidic surface treatment solution. Especially preferred is product sold by PPG/Mazer under the trademark MAZEEN® C-2 POE (2) Coco Amine. This product, which is obtained by ethoxylating coco amine, is referred to herein as "di(polyoxyethylene) coco amine".

The surface treatment composition of the invention is conveniently prepared from an aqueous solution of the polycarboxylic acid, anhydride, or salt thereof at a concentration in the range of 0.02 to 5 weight percent. The composition of the invention also preferably contains from about 0.04 to about 12 weight percent of the above-described quaternary ammonium salt and/or ethoxylated tertiary fatty amine. Particularly good results have been obtained when the quaternary ammonium salt or the ethyxolated tertiary fatty amine have been used in amounts ranging from 0.2 to 5 weight percent based on the total weight of the composition.

For transportation or storage, a concentrate of the surface treatment composition may be preferred. Thus, a solution having a concentration of polycarboxylic acid, anhydride, or salt thereof in the range of 3 to 6%, and containing 20 to 30 weight percent of quaternary ammonium salt and/or ethoxylated tertiary fatty amine may be prepared to meet such circumstances, and the surface treatment can be prepared from the concentrate at the time of use by simply diluting an appropriate amount of the concentrate with a suitable amount of water.

The components of the surface treatment composition of the invention are soluble in various organic solvents and may be formulated by dissolution in an organic solvent, if desired. As a practical matter, however, it will normally be desired to apply the surface treatment composition as an aqueous solution.

The pH of the surface treatment composition is preferably controlled between about 1.0 and about 4.5 by the addition of various inorganic or organic acids. The amount of acid added to the composition may have an effect of the viscosity of the resultant solution. Generally, the greater the amount of acid present, the lower will be the viscosity of the solution. Suitable acids for controlling the pH and viscosity of the composition include acetic acid, citric acid, oxalic acid, ascorbic acid, trifluoro acid, nitric acid, phosphoric acid, hydrofluoric acid, sulfuric acid, hydrochloric acid, and the like, either alone or in combination with one another.

The thermoplastics which may be surface treated in accordance with the present invention include, for example, nylon (polyamide), polycarbonate, polyphenylene oxide, and the like and blends thereof with various other compatible resins. The blends may include thermosetting resins so long as the resultant blend exhibits thermoplastic properties. Examples of suitable thermoplastics which have been surface treated using the composition of the invention are a nylon/polyphenylene oxide blend sold by General Electric under the name "NORYL GTX", and a polycarbonate/polyester blend also sold by General Electric under the name "XENOY".

In a typical electrostatic coating operation employing the surface treatment composition and method of this invention, the thermoplastic surface is initially cleaned by a chemical or physical process and water rinsed to remove grease and dirt therefrom. The composition of the invention is then applied to the clean thermoplastic surface. Application of the surface treatment composition to a thermoplastic surface may be carried out in various ways, including spray coating, roller coating or immersion. The appropriate mode of application may be selected by those skilled in the art in view of the overall dimensions or geometrical configuration of the surface to be treated. In any case, the mode of application should be one which causes a reasonably uniform thickness of the composition to be deposited on the thermoplastic surface. For flat surfaces, such as sheet or strip material, this may usually be accomplished most readily through the use of rollers or squeegees. The application temperature of the composition may vary over a wide range, but is preferably from 20° C. to 60° C.

Coating thickness may vary from as little as 1 micron to any desired thickness, although generally no advantage is achieved by thicknesses greater than about 25 microns, while the cost of the treatment is increased. Normally, the coating thickness for thermoplastic surfaces to acquire an acceptable level of conductivity will be at least 1 micron. In operation, processing variables will normally be determined based upon the desired coating thickness to be obtained.

The treated surface typically undergoes removal of any excess composition before drying. The excess composition may be removed from the treated thermoplastic surface by air knife blow drying, immersion in water (with or without agitation), a gentle water rinse, air pressure or ultrasound. Drying may be carried out by, for example, circulating air or infra-red oven drying. While room temperature drying may be employed, it is preferable to use elevated temperatures to decrease the amount of drying time required.

Under normal operations, it is desirable to use elevated oven temperatures and warm air streams of velocity insufficient to disturb the wet film. From a practical standpoint, the drying temperature should be well below the softening point of the thermoplastic undergoing surface treatment.

Thermoplastic surfaces treated in accordance with the present invention are characterized by a surface resistivity of between about $10^8$ ohms/cm$^2$ and about $10^{12}$ ohms/cm$^2$ or a 90% electrostatic charge decay time of less than 5 seconds. Thermoplastic surfaces thus treated will readily accept an electrostatically applied finish coating. Devices for measuring resistivity or electrostatic charge decay time are commercially available from various sources and their use is exemplified herein below. Static or charge dissipation is a function of the surface resistivity property of the material. Surface resistivity is inversely proportional to surface conductivity. In other words, the lower the value of surface resistivity, the better the ability of an applied charge to dissipate to ground. Surface resistivity testing is complementary to electrostatic charge decay measurement tests which measure the time required for an applied charge to dissipate to a predetermined cut off value. In electrostatic charge decay testing, the lower the time required for dissipation of the applied charge, the higher the surface conductivity. Hence, low resistivity values will generally correlate with low static decay times.

Finally, in one preferred embodiment of the invention, the treated surface is painted, e.g., with a reactive water based acrylic base coat followed by a clear top coat, to give the surface an attractive, glossy finish. The paint may be applied to the treated thermoplastic surface by any conventional electrostatic coating means.

Further understanding of the present invention may be had from the following examples and comparative examples which are intended to illustrate, but not limit, the invention.

EXAMPLE I

Solutions containing 0.6 grams ("g") of potassium hydrogen phthalate and 8 g of L451 in 100 g $H_2O$ were prepared at pH 3 and at pH 10. L451 contains only 50% active quaternary ammonium salt. The remainder is composed of water and isopropanol. A neutral (pH7) aqueous solution of potassium hydrogen phthalate (0.6 gm) containing 8 grams of L451 and a neutral (pH 7) aqueous solution of potassium hydrogen phthalate (0.6 gm) containing 8 grams of MAZEEN ® Coco Amine were also prepared. Each of the above-referenced solutions was used to treat a set of four (4) NORYL GTX panels (identified as I-2 to I-5), with an untreated NORYL GTX black panel (I-1) being used as a control. Panels I-2 through I-5 were each treated with the respective surface treatment solutions indicated in Table I, below. The duration of each treatment was two minutes at room temperature.

TABLE I

| PANEL NO. | TREATMENT |
|---|---|
| I-2 | Solution of L451 (pH 3) |
| I-3 | Solution of L451 (pH 10) |
| I-4 | Neutral solution of L451 |
| I-5 | Neutral solution of MAZEEN ® Coco Amine |

The surface resistivity of one side or both sides of each of Panels I-1 through I-5 was measured initially after 24 hours and again after a water wash of one side of panels I-1 through I-5. The surface resistivity (designated $S_R$, in ohms/cm$^2$), which is inversely proportional to conductivity, was measured using a surface/volume resistivity probe (Model 803A, Electro-Tech Systems, Inc., Glenside, Pa.) according to instructions provided by the manufacturer. The results obtained are set forth in Table II below.

TABLE II

Resistivity Measurements of Surface Treated Noryl GTX Panels

| | | $S_R$ (initial) | $S_R$ (post-wash) |
|---|---|---|---|
| I-1 | | $7 \times 10^{14}$ | $5 \times 10^{14}$ |
| I-2 | side 1 | $1.2 \times 10^8$ | $2 \times 10^7$ (wet!) |
| | side 2 | $2 \times 10^8$ | |
| I-3 | side 1 | $2 \times 10^8$ | $9 \times 10^{11}$ |
| | side 2 | $4 \times 10^8$ | |
| I-4 | side 1 | $4 \times 10^{10}$ | $2 \times 10^{14}$ |
| | side 2 | $6 \times 10^{10}$ | |
| 1-5 | side 1 | $1.5 \times 10^{10}$ | $1 \times 10^{13}$ |
| | side 2 | $5 \times 10^{10}$ | |

The surface resistivity values obtained for panels treated as described above showed that the solutions tested produced satisfactory results, at least initially, as surface treatment compositions for electrostatic coating of NORYL GTX.

EXAMPLE II

Conductivity of Surface Treated Panels Based on Electrostatic Charge Decay

Panels composed of XENOY ® thermoplastic were used to determine the effect of the surface treatment composition of the invention on conductivity of the treated thermoplastic as determined by electrostatic charge decay.

An aqueous solution comprising the composition of the invention was prepared by combining 280 grams L451 28 grams potassium hydrogen phthalate, 2800 grams water, and sufficient $H_2SO_4$ to a final pH of 2.0. The solution was stirred until completely homogenous. Four tests were performed utilizing this solution.

In the first three tests, XENOY panels (II-1-II-3) were immersed in the surface treatment solution for 2 minutes, followed by air drying for 2 minutes and a 45 second immersion in a stirred water bath. Thereafter, the panels were oven-dried at 60° C. for 10 minutes and then conditioned at room temperature and 44% relative humidity for 1 hour.

In the fourth test, test panel II-4 was immersed in the surface treatment solution for 2 minutes, then air dried for 2 minutes and immediately immersed in a vigorously stirred water bath for 2 minutes, until water beaded and ran off the test panel. The panel was oven-dried for 10 minutes at 60° C., then conditioned in the same way as panels II 1-II-3.

Conductivity of the first three panels (II-1-3) was measured by electrostatic charge decay at a specified relative humidity using an electrostatic charge decay meter (Model 406C, Electro-Tech Systems, Inc., Glenside, Pa.), according to the following procedure. A 5 kV charge (either positive or negative) was applied to the panel, then the charge was allowed to dissipate to a prescribed percentage of the initial charge (generally 90% or 100% charge dissipation), and the time, in seconds, required for decay of the charge to the specified level was measured. Conductivity of the treated panels is inversely proportional to the time required for the prescribed electrostatic charge decay to occur. Both positive and negative charges were applied to the panel to ensure reliable measurement of the time required for charge dissipation.

The results of electrostatic charge decay measurements on the treated panels are set forth in Table III below.

Panels II-2 and II-3, and a control XENOY panel (II-0), which had not been treated with a composition of the invention, were further evaluated by applying an electrostatic charge to the grounded panels and promptly measuring the charge decay times.

Using a 50 KV Graco electrostatic gun, a charge was applied to a grounded part of each of panels II-1-3. Immediately thereafter, a static field meter was brought to the surface of the panel to determine the presence of any charge that had not been dissipated.

TABLE III

Electrostatic Charge Decay Measurements of Treated XENOY Panels Parts

| Panel No. | DECAY TIME (sec) Positive Voltage | Negative Voltage | % Dissipation of Initial Charge |
|---|---|---|---|
| II-1 | 0.15 | 0.15 | 90% |
| | 0.99 | 0.88 | 100% |
| II-2 | 0.07 | 0.07 | 90% |
| | 0.56 | 0.54 | 100% |
| II-3 | 0.04 | 0.05 | 90% |
| | 0.30 | 0.27 | 100% |

The field meter was held one inch away from the surface of each panel. A charge of 8-10 KV/inch was measured for the control panel. No charge was measured on panels II-2 or II-3. This result indicates that the treated panels are suitably conductive for electrostatic spray painting.

EXAMPLE III

Surface Treatment of XENOY and NORYL GTX Panels And Determination of Conductivity and Paint Adhesion

A. Conductivity Of Surface Treated XENOY AND NORYL GTX

4"×6" panels composed of XENOY thermoplastic were used to determine the effect of the composition of the invention on conductivity of the thermoplastic and adhesion of subsequent electrostatically applied coatings.

An aqueous solution comprising the composition of the invention was prepared by combining 300 grams L451 30 grams potassium hydrogen phthalate, 3000 grams water and $H_2SO_4$ to a final pH of 2.0. The solution was stirred until completely homogeneous. Seven different tests were performed, five of which utilized this solution.

In the first test, an untreated XENOY panel (III-1) was washed for use as a control.

In the second test, a NORYL GTX panel (III-2) was treated with carbon black primer, as practiced in the prior art.

In the third experiment, a panel of XENOY (III-3) was sprayed with the surface treatment solution for 1 minute using an air atomizer at 42 pounds per square inch ("psi") from a distance of 17-18 inches until a thin film layer was observed on the surface. The panel was air dried for 2 hours, then stored at 40% relative humidity ("RH") until evaluated.

In the fourth test, a panel of XENOY (III-4) was immersed in the solution for 2 minutes, then air-dried for 2 minutes. The panel was then rinsed in an aqueous solution for 45 seconds. The panel was oven-dried at 60° C. for 10 minutes, then conditioned at 40% RH until evaluated.

In the fifth test, a panel of XENOY (III-5) was immersed in the solution for 2 minutes, air dried 2 minutes, immersed in a water bath for 1 minutes, 15 seconds. The panel was again dried at 60° C. for 10 minutes, then conditioned at 40% RH until evaluated.

In the sixth test, a XENOY panel (III-6) was sprayed with the surface treatment solution for 2 minutes using an air atomizer (0.7 gal/hr.) at 42 psi at a distance of 18 inches from the panel. A relatively thick film layer built up on the surface. After air drying for two minutes, the panel was immersed in a stirred water bath for 1 minute, 30 seconds. The panels were oven-dried at 60° C. for 10 minutes then conditioned at 40% RH until evaluated.

In the seventh test, a panel of XENOY (III-7) was power washed with the solution in a 5 liter can washer. The solution began to foam. A 0.5% solution of a defoamer sold by Henkel Corporation under the trademark FOAMMASTER ® VF was added; this immediately dissipated the foam, although some foam remained at the top of the solution during the spray operation. The foam did not rise as was the case when no defoamer was present. The washing cycle was 2 minutes. Next the panel, which still had foam on the surface, was immersed in stirred water for 45 seconds, then air dried and conditioned at 40% RH until evaluated.

Conductivity of panels III-3, III-4, and III-6 was measured by electrostatic charge decay at a specific relative humidity using an electrostatic charge decay meter, as described in Example II above.

The results of static decay measurements on the panels treated as described above are set forth in Table IV below.

TABLE IV

Electrostatic Charge Decay Measurements of Treated XENOY Panels

| Panel No. | DECAY TIME (sec) Positive Voltage | Negative Voltage | % Dissipation of Initial Charge |
|---|---|---|---|
| III-3 | 0.01 | 0.01 | 90% |
| | NM | NM | 100% |
| III-4 | 0.11 | 0.13 | 90% |
| | 2.01 | 2.41 | 100% |
| III-6 | 0.33 | 0.31 | 90% |
| | 2.15 | 2.09 | 100% |

NM = not measured

Panel conductivities were measured initially and then periodically at 72 hours and 300 hours. The results obtained are set forth below in Table V.

TABLE V

Conductivity of XENOY and NORYL GTX Panels

| Panel No. | Initial Conductivity (40% RH) | Conductivity Value After 72 hr at 50% RH | Conductivity after 300 hr at 40% RH |
|---|---|---|---|
| III-1 | >99 | >99 | >99 |
| III-2 | 0.01 | 0.01 | 0.01 |
| III-3 | 0.01 | 0.01 | 0.01 |
| III-4 | 0.11 | NM | 0.25 |
| III-6 | 0.33 | NM | 0.23 |
| III-7 | 0.37 | 0.13 | 0.24 |

NM = not measured

B. Adhesion of Paint to Surface Treated XENOY Panels

Panels III-1 through III-4, III-6 and III-7 were surface treated 2–3 weeks prior to the electrostatic painting. However, the panels were stored in a humidity chamber at 45% RH and 24° C. for the entire period until they were spray painted.

These panels were painted using a hand held electrostatic power paint spray gun operated at 100 KV, positive charge. The panels were hung from a conveyor belt which was negatively charged. The paint was applied by hand spraying as the panel and conveyor were moving. Approximately 1 mil coverage was obtained. The relative humidity was judged to be between 60–70%.

Each panel was air dried on a conveyor for one hour and subsequently hung in a forced air oven at 100° F. for 36 hours.

The results are set forth below in Table VI. The term "wrap around" refers to the tendency of the paint to wrap around from the surface undergoing painting and coat the reverse surface. High wrap around indicates that a higher portion of the surface is being coated which adds to the efficiency of the coating operation.

TABLE VI

| Panel No. | Comments |
|---|---|
| III-1 | The untreated XENOY showed very little wrap around on the back side of the panel. |
| III-2 | The NORYL GTX panel showed complete wrap around. |
| III-3 | The XENOY panel showed poorer wrap around than panels III-4–III-7. |

TABLE VI-continued

| Panel No. | Comments |
|---|---|
| III-4 | All of these XENOY panels showed considerably high wrap around on |
| III-5 | the back side of the panel on |
| III-6 | electrostatic spray. |
| III-7 | This XENOY panel showed very good wrap around. |

The results for panels III-4–III-7 treated with the solution of the invention were good.

EXAMPLE IV

Surface Treatment of XENOY Panels Using Various Modes of Application of Surface Treatment Composition A. Conductivity of treated XENOY panels Panels composed of XENOY thermoplastic were used to determine the effect of the mode of application of the surface treatment composition of the invention on conductivity of the surface treated thermoplastic.

An aqueous solution comprising the composition of the invention was prepared by combining 70 g L451, 7 g potassium hydrogen phthalate, 623 g water, and $H_2SO_4$ to a final pH of 2.2. The viscosity of the solution appeared to decrease with decreasing pH.

In the first test, a XENOY panel (IV-1) was immersed in the aqueous solution for 2 minutes, followed by a 1 minute immersion in a rapidly swirled water solution. The water swirled around the panel gently. The panels were oven-dried at 65° C. for 10 minutes. No visible surface film layer was observed.

The second and third experiments employed an aqueous solution comprising a composition of the invention, prepared by combining 280 grams L451, 28 grams potassium hydrogen phthalate, 2800 grams water, 2 grams FOAMMASTER® VF and $H_2SO_4$ to a final pH at 2.01.

In the second test, a XENOY panel (IV-2) was placed in a 5 liter can washer and sprayed with the surface treatment solution for two minutes. Some foaming was observed but the level of foaming did not increase during the two minute period. Because this solution was not employed for ten days, three drops of Foammaster® VF were added, as the effectiveness of this defoamer in a system of this kind was not known. Although not required in this test, an adjustment in the amount of defoamer added may be desirable for adjusting the degree of foaming of the solution.

After the two minutes of spraying with the aqueous solution, the panel was air dried for two minutes prior to rinse. A foam layer of the aqueous solution was visible on the surface of panel IV-2.

The panel was rinsed by immersion in water for one minute when all the surface film appeared to be removed. The panel was oven-dried at 60° C. for 10 minutes then conditioned for two hours at 40% RH and evaluated. The results are given in Table VII below.

The panel was measured for static decay at 48% RH. The results obtained are set forth in Table VII below.

In the third test, the second test was repeated up to the stage of conditioning the panel. The panel (IV-3) was conditioned at 42% RH for 100 minutes and then subjected to an eleotrostatic charge decay test. The results are given in Table VII.

TABLE VII

Static Decay Measurements of Treated XENOY Panels

| Panel No. | | DECAY TIME (sec) Positive Voltage | Negative Voltage | % Dissipation of Initial Charge |
|---|---|---|---|---|
| IV-1 | side 1 | 0.25 ± 0.03 | NM | 90% |
| | Side 2 | 0.31 ± 0.01 | NM | 100% |
| IV-2 | | 0.21 | 0.22 | 90% |
| | | 0.98 | 1.05 | 100% |
| IV-3 | | 1.10 | 0.87 | 90% |
| | | NM | NM | 100% |
| IV-4 | | 0.20 | 0.21 ± 0.01 | 90% |
| | | 0.78 ± 0.02 | 0.91 ± 0.03 | 100% |
| IV-5 | | 0.08 ± 0.10 | 0.09 | 90% |
| | | 0.26 ± 0.01 | 0.35 ± 0.01 | 100% |
| IV-6 | Side 1 | 0.60 ± 0.01 | 0.61 ± 0.01 | 90% |
| | Side 2 | 0.70 ± 0.01 | 0.65 ± 0.02 | 90% |
| | Side 1 | 2.61 ± 0.05 | 3.30 ± 0.22 | 100% |
| | Side 2 | 3.38 ± 0.33 | 3.35 ± 0.27 | 100% |

NM = not measured (In Table VII and subsequent tables, where some values are shown with ± limitations and other values are not, it means that the values shown with no such limits were measured too few times to obtain statistically meaningful estimates of the extent of variability. It is expected, however, that the values under these particular conditions will have the same order of variability as for the conditions where variability limits are explicitly shown.)

The fourth and fifth tests used a solution of the invention comprising 5% L451, 1% potassium hydrogen phthalate in water, and $H_2SO_4$ to a final pH of 2.0.

In the fourth test a XENOY panel (IV-4) was sprayed with an air atomizer at 0.7 gal/hr for one minute until the panel was covered completely with a thin layer. The initially glossy surface appeared cloudy after the treatment. The panel was air dried for 10 minutes, then immersed in a stirred water bath for one minute. An additional 15 seconds was required to remove residual film from the test panel. Then, the panel was oven-dried at 60° C. for 10 minutes. The panel was measured for static decay at 40% RH. The results obtained are set forth in Table VII.

In the fifth test, the surface treatment solution was applied to a XENOY panel (IV-5) by spraying from an air atomizer at 0.7 gal/hr for one minute. Complete coverage of the panel was achieved during this spraying. Thereafter, the panel was air-dried for two minutes, and then sprayed with distilled water from an air atomizer for two minutes. Additional water spraying at 0.7 gal/hr was needed in specific areas due to poor coverage. In some areas there appeared to be residual film. The panel was then oven-dried at 60° C. for 10 minutes and measured for electrostatic charge decay at 40% RH. The results obtained are set forth in Table VII.

The sixth test employed a solution of the invention comprising 70.01 g (5%) L451, 7.05 g (1%) potassium hydrogen phthalate and 700 g distilled water. A solution of $H_2SO_4$ was added to a final a pH of 1.98. The resulting solution was observed to have a slight haze. In addition, more time was required to completely dissolve the potassium hydrogen phthalate.

In the sixth test, a panel of XENOY (IV-6) was immersed in the solution for two minutes then subjected to a rinse using distilled water from a garden spray. The panel had to be sprayed twice to remove surface film in discrete regions. Then, the panel was oven-dried at 85° C. for 10 minutes. There was no visible surface film, except a small build up of film at the bottom of the panel. The panel was measured for electrostatic charge decay at 48% RH and the results obtained are set forth in Table VII.

EXAMPLE V

Surface Treatment of NORYL GTX Panels with the Composition of the Invention

A. Conductivity of NORYL GTX Panels

Panels composed of NORYL GTX thermoplastic were used to test the effect of the composition of the invention on conductivity of the thermoplastic.

An aqueous solution comprising the composition of the invention was prepared by combining 70 g L451, 7 g potassium hydrogen phthalate, 623 g water and $H_2SO_4$ to a final pH of 2.2. The viscosity of the solution decreased with decreasing pH.

In the first test, a NORYL GTX panel (V-1) was immersed in the above solution for two minutes, followed by one minute immersion in a rapidly stirred water solution. The water swirled around the panel but did not impinge on it. The panels were oven-dried at 85° C. for 10 minutes. No visible film was observed on drying. The results of electrostatic charge decay measurements on panel V-1 are summarized in Table VIII below.

For the second and third tests, an aqueous solution comprising the composition of the invention was prepared from a solution containing 0.8% by weight potassium hydrogen phthalate (0.8%) and 5% by weight of L451 at pH 3.

In the second experiment, a panel of NORYL GTX was dipped in the solution at room temperature for 2 minutes. The panel was oven-dried at 85° C. for 30 minutes. A glossy film was obtained.

The surface resistivity of each side of the panel was measured. The initial surface resistivity of side 1 was $2.6\times10^8$ ohm/cm$^2$. The initial and post-wash surface resistivities of side 2 were $2.2\times10^8$ ohm/cm$^2$ and $8\times10^8$ ohm/cm$^2$, respectively.

TABLE VIII

Electrostatic Charge Decay Measurements of Treated NORYL GTX Panels

| Panel No. | | DECAY TIME (sec) Positive Voltage | Negative Voltage | Dissipation of Initial Charge |
|---|---|---|---|---|
| V-1 | Side 1 | 0.23 | NM | 90% |
| | Side 2 | 0.30 | NM | 90 |
| V-1 | Side 1 | 1.25 ± 0.5 | NM | 100% |
| | Side 2 | 2.00 ± 1.0 | NM | 100% |

NM = not measured

In the third experiment, a panel of NORYL GTX (V-4) was immersed in the surface treatment solution at 38° C. for two minutes and oven dried at 85° C. for 30 minutes.

The initial surface resistivity of each side of the panel was measured. Side 1 and side 2 of the panel had surface resistivities of $1.2\times10^8$ ohm/cm$^2$ and $1.3\times10^8$ ohm/cm$^2$, respectively.

EXAMPLE VI

Surface Treatment of XENOY Bumper Parts

A. Conductivity

Bumper parts composed of XENOY thermoplastic were used to determine the effect of the composition of the invention on conductivity of the thermoplastic and adhesion of subsequent paint coatings.

An aqueous solution comprising the composition of the invention was prepared by combining 90 grams L451, 9 grams potassium hydrogen phthalate, 900 grams water, and $H_2SO_4$ to a final pH of 1.97. The solution was stirred until completely homogeneous. Four tests were performed utilizing this solution.

In the first test, XENOY bumper parts were cut into panels (VI-1), then immersed in the surface treatment solution for two minutes, followed by air drying for two minutes and a 30 second immersion in a stirred water bath to rinse the test panel. The rinse step was repeated three times in separate water baths to ensure complete removal of excess surface treatment solution. The panels were oven-dried at 86° C. for 15 minutes. No visible film layer was apparent.

In the second test, XENOY test panels (VI-2) were immersed in the surface treatment solution for two minutes, then immediately immersed in a stirred water bath for 30 seconds, followed by a second 30-second immersion rinse in a separate water bath to ensure complete removal of excess treatment solution. The panels were oven-dried for 10 minutes at 86° C., then conditioned at room temperature ("RT") and 55% RH for 2 hours.

In the third test, XENOY test panels (VI-3) were immersed in surface treatment solution for two minutes, then air-dried for two minutes. The panels were then immersed in a stirred water bath for one minute, followed by a 15-second immersion in a second stirred water bath. On removal from the second water bath, a film was observed on the surface of the panels, and the solution tended to coat the panel surfaces. Panels were oven-dried at 60° C. for 15 minutes, then conditioned at RT for 4 hrs.

In the fourth test, XENOY test panels (VI-4) were immersed in the surface treatment solution for 2 minutes, air dried for 2 minutes, immersed in a stirred water bath for 1 minute, and then in a second water bath for an additional 1 minute. On removal from the second water bath, only partial coating of the treatment solution on the panel surfaces was observed. The test panels were again dried at 60° C. for 15 minutes, then conditioned at RT for 4 hrs.

Conductivity of the treated panels was measured as previously described in Example II, above. The results of the electrostatic charge decay measurements on the panels treated as described above are set forth in Table IX below.

TABLE IX

Static Decay Measurements of Treated XENOY panels

| Panel No. | Relative Humidity | DECAY TIME (sec) Positive Voltage | DECAY TIME (sec) Negative Voltage | % Dissipation of Initial Charge |
|---|---|---|---|---|
| VI-1 | 56% | 0.09 ± 0.01 | 0.09 ± 0.01 | 90% |
| | | 0.40 ± 0.02 | 0.63 ± 0.02 | 100% |
| VI-2 | 56% | 0.06 ± 0.01 | 0.08 ± 0.01 | 90% |
| | | 0.19 | 0.032 ± 0.05 | 100% |
| VI-3 | 44% | 0.67 ± 0.01 | 0.74 ± 0.02 | 90% |
| | | NM | NM | 100% |

TABLE IX-continued

Static Decay Measurements of Treated XENOY panels

| Panel No. | Relative Humidity | DECAY TIME (sec) Positive Voltage | DECAY TIME (sec) Negative Voltage | % Dissipation of Initial Charge |
|---|---|---|---|---|
| VI-4 | 44% | 0.63 ± 0.00 | 0.65 ± 0.01 | 90% |
| | | NM | NM | 100% |

NM = not measured

B. Adhesion

A solution was prepared comprising 240 grams of L451, 24 grams potassium hydrogen phthalate, 2400 grams water, and $H_2SO_4$ to a final pH of 2.05. The solution was stirred for 2 hours until complete homogeneity was achieved. Two tests were performed utilizing the above solution to evaluate adhesion of electrostatically applied finish coats to surface treated XENOY bumper parts.

In the first test, panels of unpainted XENOY bumper parts were immersed in the solution for two minutes, air dried for three minutes, then immersed in two successive stirred water bath for 1.5 minutes each. Panels were oven dried at 60° C. for 10 minutes. No visible film was evident.

In the second test, panels of prepainted, XENOY bumper parts, which had not met automotive test standards after initial painting (this type of panel being briefly denoted below as "painted but rejected"), were immersed in the solution for two minutes, air dried for three minutes, then immersed in two stirred water baths for 1.5 and 1 minute, respectively. After oven-drying at 60° C. for 10 minutes, some streaks of the solution were evident on the panel surfaces.

In both tests, panels were conditioned for 4 hours at room temperature, after which conductivity was measured by electrostatic charge decay, as described above, utilizing charge dissipation of 90% of initial charge at 32% relative humidity. Panels treated in the first test exhibited decay times of 1.13±0.03 sec (positive voltage) and 1.18±0.02 sec (negative voltage). Panels treated in the second test exhibited decay times of 1.36±0.01 sec (positive voltage) and 1.57±0.04 sec (negative voltage).

The following panels of XENOY bumper parts were subsequently painted: (1) untreated, unpainted; (2) untreated, painted but rejected; (3) treated, unpainted; (4) treated, painted but rejected; and (5) a panel treated in the first test of Example VI, part A, above. After painting, each panel was scribed with a knife to form 100 squares. Two sets of scribes were made in each panel: one set to be used in dry adhesion testing and the other set to be used in wet adhesion testing.

For the dry adhesion test, PERMACEL 610 tape was placed over the scribed area, then peeled off. All five panel treatments retained 100% of the scribed squares (i.e., no squares peeled off with tape).

For the wet adhesion test, each panel was soaked in warm water (100°±2° F.) for 24 hours, after which panels were removed, dried and subject to the peel test using Permacel 610 tape, as above. Again, all five panel treatments retained 100% of the scribed squares. The panel from the first test of part A, above was further subject to 100° F. water immersion for 100 hours (about 5 days), and again retained 100% of the scribed squares in the peel test.

EXAMPLE VII

Testing of Alternative Formulation of Surface Treatment Composition

To determine whether phthalic anhydride could be substituted for potassium hydrogen phthalate in the composition of the invention, the following solution was prepared: 90 grams L451, 9 grams phthalic anhydride, 900 grams water, 0.1% FOAMMASTER® VF defoamer and $H_2SO_4$ to a final pH of 1.98.

Combining the above materials initially resulted in a heterogeneous mixture, with the phthalic anhydride dissolving slowly at first, but finally becoming completely dissolved. It should be noted that, at the pH of the solution, phthalic anhydride exists as phthalic acid; however, no potassium salt was present in this solution, as compared to solutions described above comprising potassium hydrogen phthalate. A comparison of solutions prepared with phthalic anhydride, as opposed to potassium hydrogen phthalate was made by Fourier-transform infrared spectroscopy. The similarity of the two spectra suggested that the same compound was formed by the interaction of phthalic anhydride with L451, as was formed by the interaction between potassium hydrogen phthalate with L451.

To test the L451/phthalic anhydride solution for effectiveness as a surface treatment composition for electrostatic coating, a panel of XENOY thermoplastic identified as VII-1 was immersed in the solution for two minutes, air dried for two minutes, then immersed in stirred water bath for 45 seconds. The panel was then oven-dried at 60° C. for 10 minutes, conditioned at 50% RH for 4 hours, and subjected to static decay measurements, as shown in Table X, below.

TABLE X

Conductivity of XENOY Thermoplastic Treated with L451-Phthalic Anhydride Solution

| Panel No. | Relative Humidity | Decay Time (sec) Positive Voltage | Decay Time (sec) Negative Voltage | % Dissipation of Initial Charge |
|---|---|---|---|---|
| VII-1 | 37% | 0.05 | 0.05 | 90% |
| | | 0.51 ± 0.03 | 0.47 ± 0.02 | 100% |
| VII-2 | 50% | 0.02 | 0.02 | 90% |
| | | 0.17 ± 0.01 | 0.15 ± 0.01 | 100% |

These results indicate that aqueous solutions of L451-phthalic anhydride are equally as effective as solutions comprising potassium hydrogen phthalate in imparting suitable surface conductivity to XENOY thermoplastic.

EXAMPLE VIII

Effect of Humidity and Temperature on Performance of Surface Treatment Composition

A. Effect of Humidity

A surface treatment solution was prepared comprising 5% by weight of L451, 1% by weight of potassium hydrogen phthalate, water and $H_2SO_4$ to a final pH of 2.05. Prewashed XENOY panels were immersed in the solution for two minutes, air dried two minutes, then immersed in a stirred water bath for 45 seconds, followed by immersion in a second stirred water bath for 30 seconds. After removal from the second bath, the test panels were observed to have a film layer of the surface treatment solution strongly adhering to them, but after oven drying at 60° C. for 20 minutes, no lip or surface marks were visible.

The conductivity of treated panels, identified as VIII-1 and VIII-2, at differing relative humidities, was tested by electrostatic charge decay measurement, as shown in Table XI, below.

TABLE XI

Conductivity of Treated XENOY Panels at Varying Relative Humidity

| Panel No. | Treatment (Rel. Hum.) | Decay Time (sec) Positive Voltage | Decay Time (sec) Negative Voltage | Charge Dissipation % of Initial Charge |
|---|---|---|---|---|
| VIII-1 | 37% | 0.11 ± 0.01 | 0.12 | 100 |
| | | 0.04 | 0.04 ± 0.01 | 90 |
| | | 0.01 | 0.01 | 50 |
| | 50% | 0.03 ± 0.01 | 0.04 ± 0.01 | 100 |
| | | 0.01 ± 0.01 | 0.01 ± 0.01 | 90 |
| | 50% | 0.03 ± 0.01 | 0.03 ± 0.01 | 100 |
| | (after 48h) | 0.01 ± 0.01 | 0.01 ± 0.01 | 90 |
| VIII-2 | 30% | 0.46 ± 0.03 | 0.51 ± 0.01 | 100 |
| | | 0.06 ± 0.01 | 0.09 | 90 |
| | | 0.02 | 0.02 | 50 |
| | 37% | 0.17 ± 0.01 | 0.20 ± 0.01 | 100 |
| | | 0.05 ± 0.01 | 0.04 ± 0.01 | 90 |
| | | 0.02 | 0.02 | 50 |
| | 50% | 0.04 ± 0.01 | 0.06 | 100 |
| | | 0.02 ± 0.01 | 0.02 | 90 |
| | | 0.01 | 0.01 | 50 |
| | 65% | 0.02 ± 0.01 | 0.02 ± 0.01 | 100 |
| | | 0.01 ± 0.01 | 0.01 ± 0.01 | 90 |
| | | 0.01 ± 0.01 | 0.01 ± 0.01 | 50 |

B. Effect of Temperature

A solution, comprising 5% L451, 1% phthalic anhydride, water and $H_2SO_4$ to a final pH of 1.98, was prepared as described in Example VII, above. The solution was divided into four parts, each part being brought to a selected temperature of either 25° C., 35° C., 45° C. or 55° C. The viscosity of the solution was measured at each temperature; then XENOY panels identified as panels VIII-3, VIII-4, VIII-5 and VIII-6 were treated with the solutions at each temperature, as described in Example VIII A above. Following treatment, conductivity of treated panels was measured by static decay at 40% RH, as shown in Table XII below.

TABLE XII

Effect of Temperature of Quaternary Salt Solution on Conductivity of Treated Panels

| Panel No. | Solution Temperature (C.) | Decay Time (sec) Positive Voltage | Decay Time (sec) Negative Voltage | % Dissipation of Initial Charge |
|---|---|---|---|---|
| VIII-3 | 25 | 0.41 | 0.44 ± 0.02 | 90 |
| | | 1.59 ± 0.21 | 2.16 ± 0.22 | 100 |
| VIII-4 | 35 | 0.41 ± 0.01 | 0.40 ± 0.01 | 90 |
| | | 3.23 ± 0.51 | 2.78 ± 0.44 | 100 |
| VIII-5 | 45 | 0.18 ± 0.01 | 0.18 ± 0.01 | 90 |
| | | 0.54 ± 0.02 | 0.78 ± 0.02 | 100 |
| VIII-6 | 55 | 0.34 | 0.34 ± 0.01 | 90 |
| | | 1.56 ± 0.02 | 1.46 ± 0.05 | 100 |

These results demonstrate that solution temperature variations ranging from 25° C. to 55° C. have no significant effect on the conductivity of treated XENOY thermoplastic panels. It should be noted, however, that on cooling the 55° C. solution back to 25° C., the solution began to gel, increasing in viscosity from 4 centipoises ("cp") to 24 cp. This phenomenon was not observed in cooling from the lower temperatures.

EXAMPLE IX

Effect of Varying Selected Treatment Parameters on Conductivity of Two Thermoplastics The following table (Table XIII) summarizes the effect of varying washing and aging conditions on the conductivity of two thermoplastics, NORYL GTX and XENOY. Panels of NORYL GTX and XENOY (identified as IX 1–IX-11) were either untreated, for use as a control, or treated with an aqueous solution comprising 5% L451, 1% potassium hydrogen phthalate, with pH adjusted to about 2.0 by $H_2SO_4$. Washing treatments included the following: (1) no wash; (2) at least one immersion of 30–45 seconds in a stirred water bath; (3) mist spray of water for 30 seconds from a distance of 1 ft; (4) vigorous rinse under running water for 30–45 seconds; and (5) air-drying for 2–3 minutes prior to washing. Aging (conditioning) treatments included (1) no aging; (2) aging at room temperature 24–88 hours; and (3) aging at 65° C. for 4 hours.

Conductivity of treated panels was measured at relative humidities ranging from 35% to 66%, utilizing two different measurements: electrostatic charge decay and surface resistivity. The electrostatic charge decay measurement is described in Example II above. The measurements obtained are set forth in Table XIII below.

EXAMPLE X

Use of Air Jet or Air Knife to Remove Excess Composition

Panels composed of XENOY thermoplastic were used to test the effect of using a high velocity air stream to remove excess surface treatment composition on the panels surface.

In the first test, an aqueous solution comprising the composition of the invention was prepared by combining 5.2 grams L451, 0.52 grams potassium hydrogen phthalate, 900 grams water, and $H_2SO_4$ to a final pH of 2.0. The resulting solution was observed to be clear, having the appearance of water.

A XENOY panel (X-1) was immersed in the above solution for two minutes. After removal, a film was observed on the surface of the panel. The panel was placed adjacent to an air jet exerting a pressure of 40 psi as measured from the air atomized nozzle. The volatiles wicked off the surface. No residual film was observed on the surface although near the edges of the panel there was some indication of "track marks" on drying. The panel was oven dried at 43° C. for 20 minutes. No surface film or other residue was observed.

TABLE XIII

Effect of Solution of the Invention on Thermoplastic Panels

| Panel No. | Thermo-Plastic | Wash Trtmt. | Aging Trtmt. | Rel. Hum. | Avg. Electrostatic Charge Decay Time (sec) Charge Dissipation 90% | 100% | Surface Resistivity (ohms/cm$^2$) |
|---|---|---|---|---|---|---|---|
| IX-1 | NORYL-GTX | Un-treated (Control) | | 35% | 46.75 | — | $8.5 \cdot 10^{14}$ |
| | | | | 40% | | — | $7.0 \cdot 10^{14}$ |
| IX-2 | | Mist Spray | | 35% | 2.70 | 24.5 | — |
| | | | | 40% | 0.81 | 2.51 | $5.2 \cdot 10^{11}$ |
| | | | | 40% | 0.80 | — | $1.0 \cdot 10^{11}$ |
| IX-3 | | Immer-sion | | 35% | 0.56 | 2.10 | — |
| | | | | 48% | 0.27 | 1.70 | $4.1 \cdot 10^{11}$ |
| | | | | 60% | 0.33 | 1.90 | — |
| | | | | 66% | 0.10 | 0.46 | — |
| IX-4 | | Vigorous Rinse | | 35% | 23.25 | — | — |
| IX-5 | | Immer-sion | No Aging | 35% | 0.59 | 2.10 | |
| | | | 65° C., 4 hrs | 35% | 0.95 | 4.60 | |
| | | | No Aging | 35% | 0.59 | 2.10 | |
| | | | RT 24 hrs | 35% | 1.39 | 6.60 | |
| | | | RT 48 hrs | 39% | 1.28 | 5.40 | |
| | | | RT 88 hrs. | 44% | 1.09 | 4.10 | |
| IX-6 | XENOY | Un-treated (Control) | | 35% | >99 | — | $>1 \cdot 10^{17}$ |
| | | | | 40% | >99 | — | $>1 \cdot 10^{17}$ |
| IX-7 | | Mist Spray | | 40% | 0.20 | 1.30 | — |
| | | | | 48% | 0.65 | 3.38 | — |
| IX-8 | | Immer-sion | | 35% | 1.30 | 3.90 | — |
| | | | | 40% | 0.31 | 1.50 | $3.9 \cdot 10^{10}$ |
| | | | | 48% | 0.30 | 1.05 | $2.6 \cdot 10^{11}$ |
| | | | | 66% | 0.44 | 2.77 | — |
| IX-9 | | Vigor-ous Rinse | | 40% | 20.30 | — | $3 \cdot 10^{13}$ |
| IX-10 | | Air dry, then Immersion | | 40% | 0.34 | — | — |
| IX-11 | | Air dry, then | | 40% | 26.25 | — | — |

TABLE XIII-continued

| Effect of Solution of the Invention on Thermoplastic Panels | | | | | | | |
|---|---|---|---|---|---|---|---|
| | | | | | Avg. Electrostatic Charge Decay Time (sec) | | |
| Panel No. | Thermo-Plastic | Wash Trtmt. | Aging Trtmt. | Rel. Hum. | Charge Dissipation 90% | Charge Dissipation 100% | Surface Resistivity (ohms/cm$^2$) |
| | | Vigorous Rinse | | | | | |

The panel was conditioned for 24 hours at 50% RH. The results of electrostatic charge decay measurements and surface resistivity measurements are given in Table XIII.

In the second test, an aqueous solution comprising the composition of the invention was prepared by combining 7.2 grams L451, 0.7 grams potassium hydrogen phthalate, 900 grams water, and $H_2SO_4$ to a final pH of 2.0. The resulting solution was observed to have the appearance of water.

A XENOY panel (X-2) was immersed in the above solution for two minutes. After removal, the surface of the panel was air dried with an air jet having a nozzle pressure set at 40 psi. Liquid volatiles were observed to be removed completely from each surface of the panel within 20 seconds of application of the air jet on the surface. No residual film was apparent on either surface although wisps of film were observed near the edges of the panel. This appearance is due to the mode of excess removal used, rather than a property of the treatment solution. Then, the panel was oven dried at 43° C. for 20 minutes. The panel was conditioned for 24 hours at 50% RH. The results of electrostatic charge decay measurements and surface resistivity measurements are given in Table XIV below.

TABLE XIV

| Static Decay Measurements and Surface Resistivity Measurements of Treated XENOY Panels | | | | | |
|---|---|---|---|---|---|
| Panel No. | Relative Humidity | Positive Voltage | Negative Voltage | % Dissipation of Initial Charge | Surface Resistivity (ohm/cm$^2$) |
| X-1 | 50% | 0.01 | 0.01 | 90% | $3.9 \times 10^{10}$ |
| | | 0.02 | 0.02 | 100% | |
| X-2 | 50% | 0.01 | 0.02 ± 0.01 | 90% | $4.3 \times 10^{10}$ |
| | | 0.06 ± 0.01 | 0.07 ± 0.01 | 100% | |

While it is apparent that the various embodiments of the invention disclosed and exemplified are well suited to fulfill the above-stated objects, it will be appreciated that the invention is susceptible to modifications, variations and change without departing from the spirit of the invention, the full scope of which is delineated by the appended claims.

What is claimed is:

1. A composition of matter, comprising:

(A) a component selected from the group consisting of substituted and unsubstituted aromatic polycarboxylic acids, anhydrides of substituted and unsubstituted aromatic polycarboxylic acids, salts of substituted and unsubstituted aromatic polycarboxylic acids, and mixtures of any two or more of these;

(B) a component selected from the group consisting of quaternary ammonium salts, ethoxylated tertiary fatty amines, and mixtures of any two or more of these; and (C) a liquid vehicle component, in which components (A) and (B) are both dissolved or dispersed, said composition having the property that, after being contacted with the composition, a thermoplastic surface selected from the group consisting of polycarbonate, nylon, polyphenylene oxide, and blends thereof will have a surface resistivity value of between about $10^8$ ohms/cm$^2$ and about $10^{12}$ ohms/cm$^2$, a 90% electrostatic charge decay time of less than five seconds, or both.

2. A composition as claimed in claim 1 with a pH not greater than 4.5, wherein component (A) is selected from the group consisting of phthalic acid, phthalic anhydride, isophthalic acid, terephthalic acid, homophthalic acid, the mono-alkali metal salts of these acids, and mixtures of any two or more of these; and component (C) consists predominantly of water.

3. A composition as claimed in claim 2, wherein component (A) is selected from the group consisting of phthalic acid, phthalic anhydride, mono-alkali metal salts of phthalic acid, and mixtures of any two or more of these.

4. A composition as claimed in claim 1, comprising at least one quaternary ammonium salts having the formula:

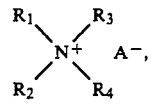

wherein $R_1$ is selected from the group sting of:

(a) branched and unbranched alkyl and alkenyl substituents having 6 to 22 carbon atoms; and (b) substituents of the formula Ra—X—Rb, wherein Ra is a branched or unbranched monovalent group having 6 to 19 carbon atoms, Rb is a monovalent group having from 1 to 3 carbon atoms, each of Ra and Rb independently being hydrocarbon groups or groups that are hydrocarbon except for being substituted with a —COOH or —OH group, and X represents a linking moiety selected from the group consisting of —O—, —CONH—, and —COO—;

$R_2$ is selected from the group consisting of branched and unbranched alkyl and hydroxyalkyl groups having 1 to 4 carbon atoms in each group;

each of $R_3$ and $R_4$ is independently selected from the group consisting of branched and unbranched alkyl and alkenyl moieties, monovalent moieties that are hydrocarbon except for being substituted with —COOH or —OH, and moieties of the formula Ra—X—Rb as given above, each of $R_3$ and $R_4$ containing from 1–22 carbon atoms; and $A^-$ represents a halide, nitrate, or a lower alkyl sulfate anion, said composition having a pH not greater than 4.5 and a component (C) that consists predominantly of water.

5. A composition as claimed in claim 4, wherein component (B) is selected from the group consisting of stearyldimethylethyl ammonium ethosulfate, stearamidopropyldimethyl-$\beta$-hydroxyethyl ammonium nitrate, N,N-bis(2-hydroxyethyl)-N-(3'-dodecyloxy-2'-hydroxypropyl) methylammonium methosulfate, and mixtures of any two or more of these quaternary ammonium salts.

6. A composition as claimed in claim 5, wherein component (B) is stearyldimethylethyl-ammonium ethosulfate.

7. A composition as claimed in claim 6 wherein component (A) is selected from the group consisting of phthalic acid, phthalic anhydride, mono alkali metal salts of phthalic acid, and mixtures of any two or more of these.

8. A composition as claimed in claim 1, wherein component (B) is selected from the group of ethoxylated tertiary fatty amines and mixtures of any two or more of these and component (C) consists predominantly of water.

9. A composition as claimed in claim 8 with a pH not greater than 4.5, wherein component (A) is selected from the group consisting of phthalic acid, phthalic anhydride, mono alkali metal salts of phthalic acid, and mixtures of any two or more of these and component (B) consists predominantly of di(polyoxyethylene) coco amine.

* * * * *